US010337813B2

(12) United States Patent
Jonsson

(10) Patent No.: US 10,337,813 B2
(45) Date of Patent: Jul. 2, 2019

(54) BULLPUP CONVERSION KIT FOR FIREARM

(71) Applicant: Manticore Arms, Inc., Elburn, IL (US)

(72) Inventor: Sven Jonsson, North Aurora, IL (US)

(73) Assignee: Manticore Arms, Inc., Elburn, IL (US)

( * ) Notice: Subject to any disclaimer, the term of this patent is extended or adjusted under 35 U.S.C. 154(b) by 4 days.

(21) Appl. No.: 15/851,194

(22) Filed: Dec. 21, 2017

(65) Prior Publication Data

US 2018/0195822 A1 Jul. 12, 2018

Related U.S. Application Data

(60) Provisional application No. 62/445,656, filed on Jan. 12, 2017.

(51) Int. Cl.

| | |
|---|---|
| ***F41A 3/66*** | (2006.01) |
| ***F41A 17/38*** | (2006.01) |
| ***F41A 19/09*** | (2006.01) |
| ***F41A 19/10*** | (2006.01) |
| ***F41C 23/16*** | (2006.01) |
| ***F41C 23/20*** | (2006.01) |
| ***F41A 11/02*** | (2006.01) |
| ***F41G 11/00*** | (2006.01) |

(52) U.S. Cl.

CPC ..... *F41A 11/02* (2013.01); *F41A 3/66* (2013.01); *F41A 17/38* (2013.01); *F41A 19/09* (2013.01); *F41A 19/10* (2013.01); *F41C 23/16* (2013.01); *F41C 23/20* (2013.01); *F41G 11/003* (2013.01)

(58) Field of Classification Search

CPC ..... F41A 11/02; F41A 17/38; F41A 19/09; F41A 19/10; F41C 23/16; F41C 23/20

See application file for complete search history.

(56) References Cited

U.S. PATENT DOCUMENTS 4,463,654 A * 8/1984 Barnes ..... F41A 19/09 42/74

5,038,507 A * 8/1991 Dennis, Jr. ..... F41A 3/04 42/69.01

(Continued)

OTHER PUBLICATIONS

International Search Report and Written Opinion dated Mar. 30, 2018 corresponding to International Application No. PCT/US2018/013333, 15 pages.

*Primary Examiner* — Joshua T Semick

(74) *Attorney, Agent, or Firm* — Harness, Dickey & Pierce, P.L.C.

(57) ABSTRACT

A bullpup conversion kit for a firearm including a lower receiver with a topside channel that partially receives an upper receiver of the firearm and a magazine well. The firearm includes a trigger pack with a removable trigger. A trigger bar assembly including a trigger bar, a front trigger mount, and a trigger shoe is received within the topside channel. The trigger bar extends along one side of the magazine well. The front trigger mount is disposed on a forward end of the trigger bar. The trigger shoe includes upper and lower ends. The upper end of the trigger shoe is pivotally coupled to the trigger pack in place of the removable trigger. The lower end of the trigger shoe is connected to a rearward end of the trigger bar by a pin. The lower receiver hinges away from the upper receiver about a front hook during disassembly.

18 Claims, 7 Drawing Sheets

(56) References Cited

U.S. PATENT DOCUMENTS

| | | | | |
|---|---|---|---|---|
| 7,356,958 | B2 * | 4/2008 | Weir | F41A 19/00 42/42.02 |
| 9,115,954 | B1 | 8/2015 | Corsi et al. | |
| 9,347,725 | B2 * | 5/2016 | McAlister | F41A 19/10 |
| 9,677,846 | B1 * | 6/2017 | Vankeuren, III | F41C 23/20 |
| 2006/0026885 | A1 * | 2/2006 | Tony | F41A 19/10 42/105 |
| 2011/0283582 | A1 | 11/2011 | Hunter et al. | |
| 2013/0185975 | A1 | 7/2013 | Johnson | |
| 2014/0075812 | A1 | 3/2014 | Johnson | |
| 2015/0107143 | A1 | 4/2015 | Coetzee et al. | |
| 2015/0219421 | A1 | 8/2015 | Zamlinsky | |
| 2015/0316339 | A1 * | 11/2015 | Young | F41A 11/02 42/49.01 |
| 2015/0338181 | A1 | 11/2015 | McAlister | |
| 2017/0131051 | A1 * | 5/2017 | Albury | F41A 11/00 |

* cited by examiner

BULLPUP CONVERSION KIT FOR FIREARM

CROSS REFERENCE TO RELATED APPLICATION

This application claims the benefit of U.S. Provisional Application No. 62/445,656, filed on Jan. 12, 2017. The entire disclosure of the application referenced above is incorporated herein by reference.

FIELD

The present disclosure generally relates to firearms and more specifically to kits for converting firearms to bullpup configurations.

BACKGROUND

This section provides background information related to the present disclosure which is not necessarily prior art.

Firearms, and specifically longarms that are meant to be shouldered, are designed to work with the ergonomics of the human body. In order to shoulder a longarm comfortably and effectively, a certain amount of space is required between the buttpad of the stock and the trigger of the longarm.

In traditional magazine fed longarm configurations, a stock extends from the buttpad or buttplate to the rear of the receiver. The stock may be made of various materials such as wood, plastic, and/or metal. The stock is typically 12-16 inches in length and provides the space required between the trigger of the firearm and the buttpad or buttplate to comfortably shoulder the longarm. While such stocks make a longarm ergonomic, they add length and weight to the firearm. The length disadvantage can be mitigated somewhat by making the stock foldable so that it lies along side or under the firearm, but when the stock is folded the advantage of the stock is lost, so it becomes an "either/or" option of compactness versus ergonomics, safety, and accuracy during firing.

One solution to this problem is to convert a longarm to what is known as a "bullpup" configuration or layout, where the buttplate is affixed directly to the rear of the receiver of the firearm. To maintain proper spacing between the buttplate and the trigger for good ergonomics (typically 12-16 inches) the trigger and grip are moved forward of the magazine well. In the "bullpup" configuration, a new trigger is typically linked from its location forward of the magazine well via a pair of bars or cables to the existing trigger of the firearm, which is located in the traditional location behind the magazine well location.

Thus, by configuring a longarm firearm as a "bullpup," the length of pull from the trigger to the buttpad is maintained while removing the need for a traditional stock. In effect, the receiver of the weapon itself doubles as the stock, thus creating a lighter, more compact firearm over the traditional longarm layout. Despite these advantages, there are a number of disadvantages and drawbacks associated with existing bullpup conversion kits. First, the pair of bars or cables that link the forward trigger to the existing trigger of the firearm are prone to jam and/or slip because the pair of bars or cables push on the existing trigger of the firearm. Second, the length of pull and the pull weight for the forward trigger is often different from that of the existing trigger of the firearm and therefore deviates from the firearm manufacturer's specifications. Also, portions of the pair of bars or cables are often left exposed after the longarm has been converted to a bullpup configuration and existing designs often look crude and unfinished because the pair of bars or cables push on the existing trigger of the firearm. In addition, existing bullpup conversion kits are not compatible with certain firearms. For example, the location of the pair of bars or cables can interfere with other components of the firearm such that some firearms cannot be modified to include a pair of bars or cables to connect the forward trigger to the existing trigger of the firearm. Finally, existing bullpup conversion kits are complex, making the firearm difficult and time-consuming to assemble and disassemble. Accordingly, there is a need for improved bullpup conversion kits.

SUMMARY

This section provides a general summary of the disclosure and is not a comprehensive disclosure of its full scope or all of its features.

In accordance with one aspect of the subject disclosure, a bullpup conversion kit for a firearm is described. The firearm includes an upper receiver, a barrel that extends from the upper receiver, and a trigger pack with a removable trigger. The bullpup conversion kit includes a lower receiver that extends longitudinally between a front end and a rear end. The lower receiver has a topside channel that is configured to receive at least part of the upper receiver of the firearm and the front end of the lower receiver includes a trigger slot. The top side channel of the lower receiver includes a trigger pack pocket that is positioned longitudinally between the trigger slot and the rear end of the lower receiver. The trigger pack pocket is configured to receive the trigger pack of the firearm. The bullpup conversion kit also includes a trigger bar assembly that is entirely received within the topside channel of the lower receiver. The trigger bar assembly includes a trigger bar, a front trigger mount, and a trigger shoe. The trigger bar extends between a forward end and a rearward end. The front trigger mount is disposed on the forward end of the trigger bar and is configured to receive the removable trigger of the firearm. The trigger shoe includes an upper end that is configured to be pivotally coupled to the trigger pack in place of the removable trigger and a lower end that is connected to the rearward end of the trigger bar by a trigger bar pin.

In accordance with another aspect of the subject disclosure, the lower receiver of the bullpup conversion kit includes a bottom wall, an ejection side wall, and a non-ejection side wall. The lower receiver includes a magazine well that is open to the topside channel and extends through the bottom wall of the lower receiver for receiving a magazine. The lower receiver also includes a trigger bar channel that extends along one side of the magazine well and the trigger pack pocket. The trigger bar is disposed in and extends through the trigger bar channel in the lower receiver such that the trigger bar extends along only one side of the magazine well.

In accordance with another aspect of the subject disclosure, the front end of the lower receiver of the bullpup conversion kit includes a front hook that is configured to engage an opening in the upper receiver. The lower receiver also includes a cross-pin bore that extends through the ejection side wall and the non-ejection side wall of the lower receiver adjacent to the magazine well. A cross-pin, configured to engage a bore in the upper receiver, extends transversely across the topside channel and is received in the cross-pin bore. The bullpup conversion kit also includes a buttplate having a cantilevered shelf that abuts the bottom wall of the lower receiver adjacent to the rear end of the lower receiver. Together, the front hook, the cross-pin, and the buttplate provide three points of attachment between the lower receiver and the upper receiver. The lower receiver is free to pivot towards and away from the upper receiver about the front hook when the cross-pin and the buttplate are removed from the upper receiver during assembly or disassembly of the firearm.

Advantageously, the bullpup conversion kit of the subject disclosure solves many of the disadvantages and drawbacks associated with other bullpup conversion kits. First, the firearm manufacturer's specifications for the length of pull and the pull weight for the trigger can be maintained or adjusted as desired because the trigger shoe replaces the removable trigger of the firearm and the trigger bar is securely coupled to the trigger shoe by the trigger bar pin. Second, because the trigger bar is entirely received in the topside channel of the lower receiver, the trigger bar is protected and the bullpup conversion kit has a finished appearance with improved aesthetics. Third, the disclosed bullpup conversion kit is compatible with firearms that have an ejector and/or a bolt hold open mechanism adjacent to the magazine well because the trigger bar runs along only one side of the magazine well and therefore does not interfere with the ejector or the bolt hold open mechanism.

The bullpup conversion kit of the subject disclosure has several more advantages, which are described below. It is fast and easy to assemble and disassemble the firearm because the front hook on the lower receiver of the subject bullpup conversion kit allows the lower receiver to hinge or pivot relative to the upper receiver of the firearm. This facilitates proper alignment of the upper and lower receivers. In addition, the subject design provides three points of attachment between the upper and lower receivers and the trigger bar assembly is carried on the lower receiver, which also makes assembly and disassembly of the firearm fast and easy. Finally, the bullpup conversion kit uses the existing hand grip, removable trigger, trigger pack, ejector, bolt hold on mechanism, cross-pin, and magazine thus making it possible to easily convert the firearm into the bullpup configuration with a minimum of new components. This also gives the bullpup conversion an appearance and operation that is familiar to users of the firearm.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION

Figure 1:
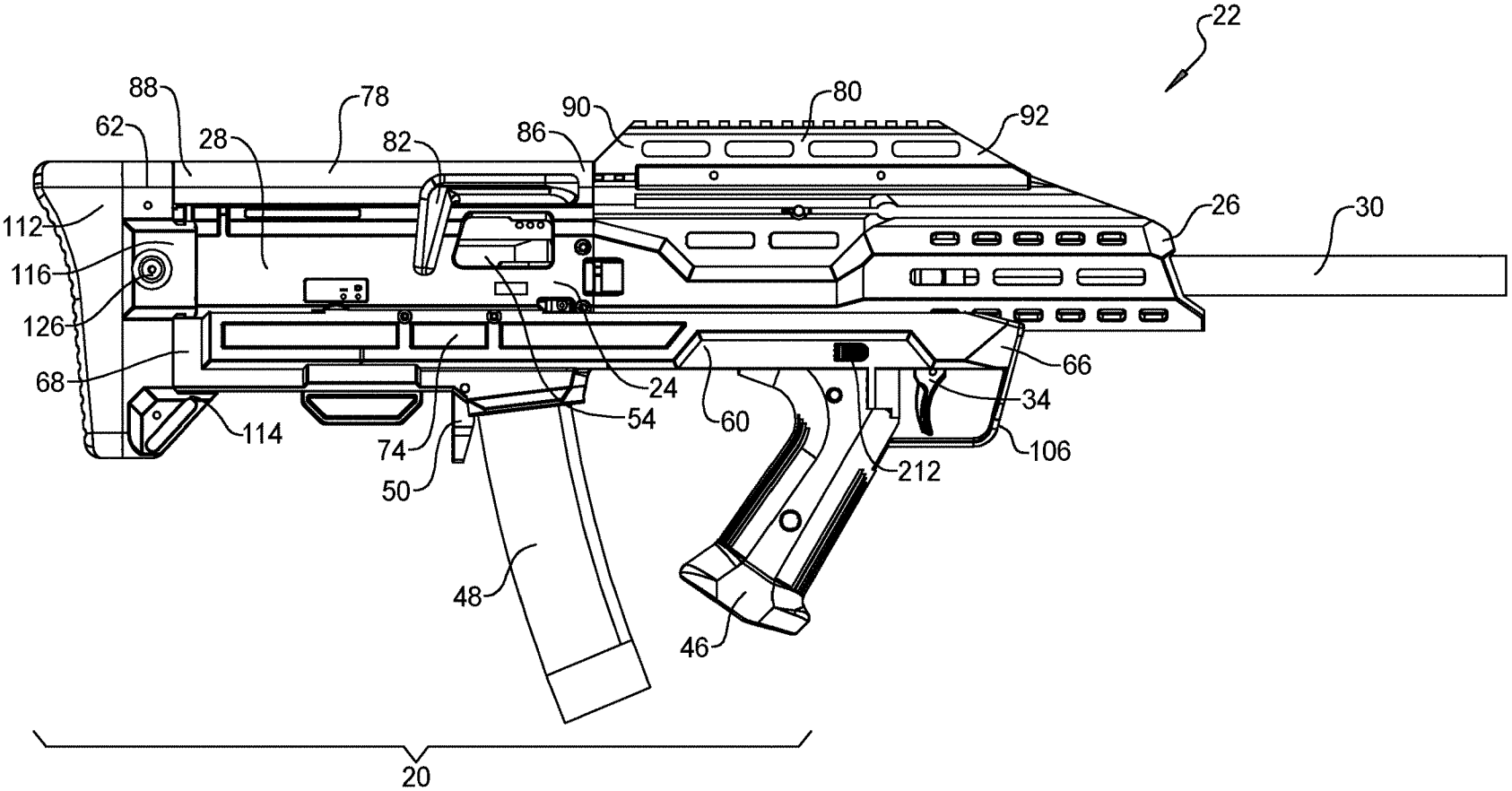
FIG. 1 is a right-side elevation view of an exemplary firearm assembled using an exemplary bullpup conversion kit that is constructed in accordance with the subject disclosure.

Referring to the Figures, wherein like numerals indicate corresponding parts throughout the several views, a bullpup conversion kit 20 for a firearm 22 is illustrated.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
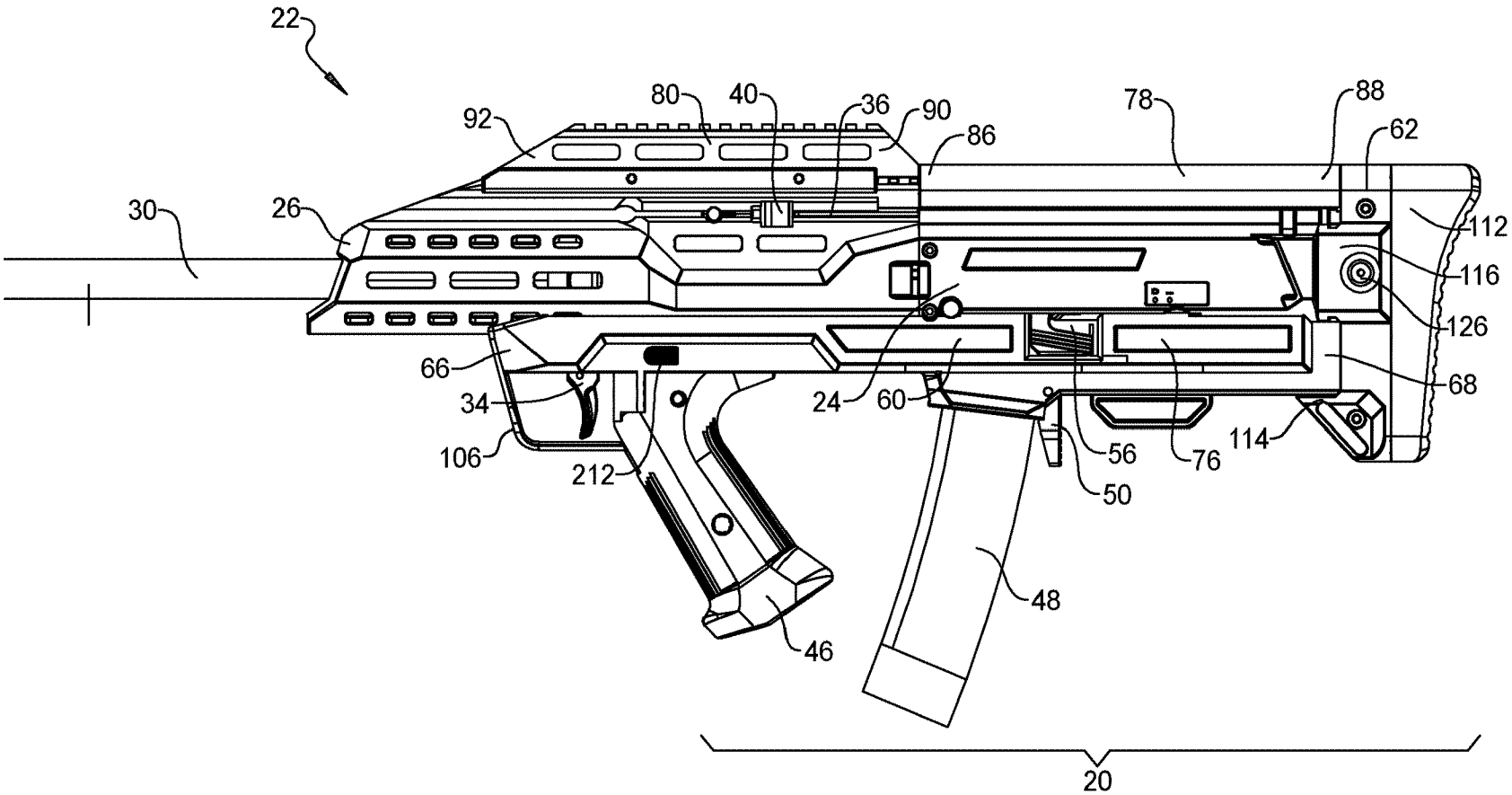
FIG. 2 is a left-side elevation view of the exemplary firearm and bullpup conversion kit illustrated in FIG. 1.
Figure 3:
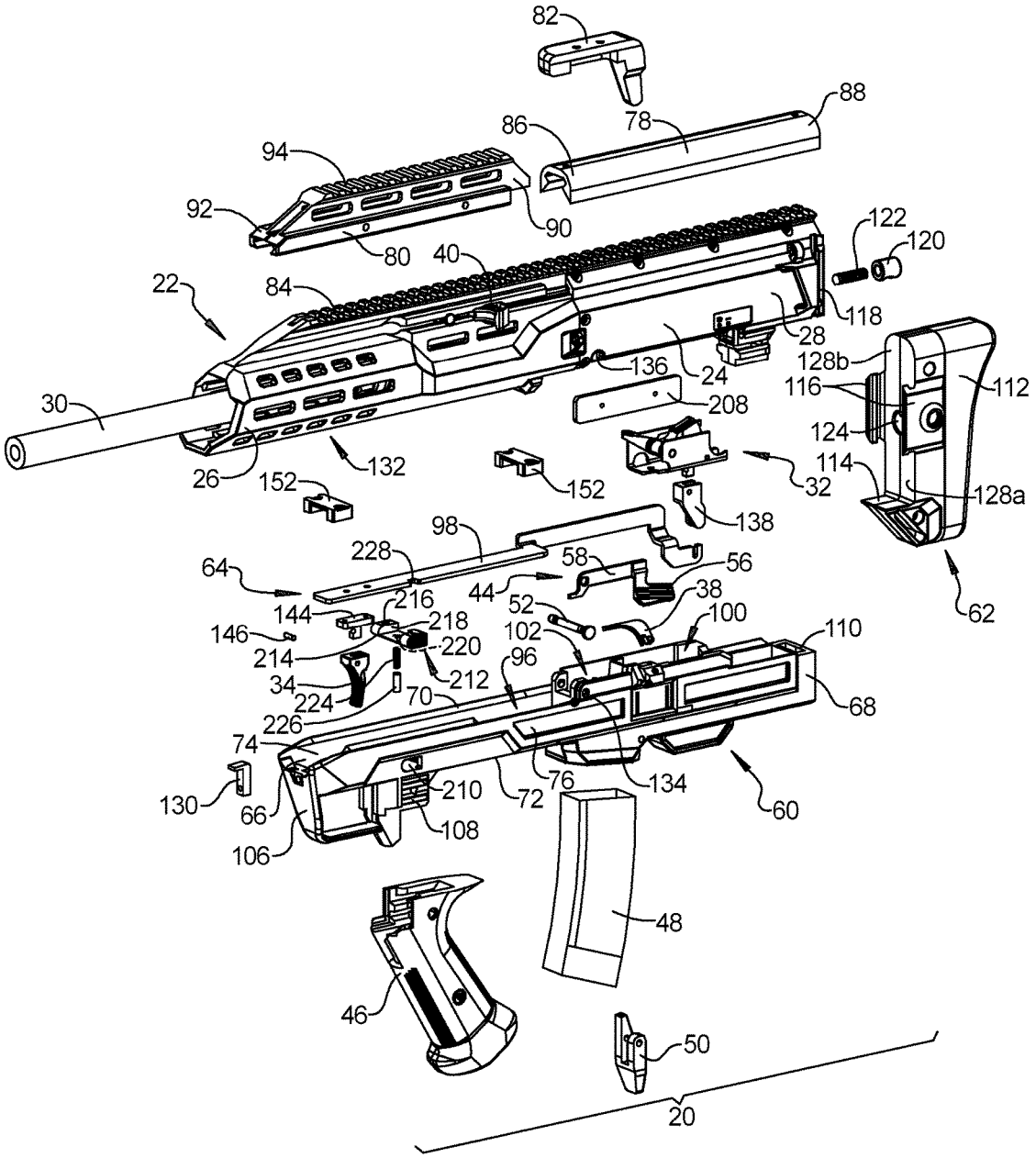
FIG. 3 is an exploded side perspective view of the exemplary firearm and bullpup conversion kit illustrated in FIG. 1.

With reference to FIGS. 1-3, the bullpup conversion kit 20 is designed to be assembled with various existing components of the firearm 22. These components of the firearm 22 include, without limitation, an upper receiver 24 that extends longitudinally from a fore end 26 to a back end 28, a barrel 30 that extends from the upper receiver 24, a trigger pack 32 with a removable trigger 34, a bolt 36 housing a firing pin (not shown), an ejector 38, a charging handle 40, a bolt hold open mechanism 44, a hand grip 46, a magazine 48, a magazine release lever 50, and a cross-pin 52. The bolt 36 slides within the upper receiver 24. The upper receiver 24 includes an ejection port 54. The ejector 38 pushes a spent shell out through the ejection port 54 after a round of ammunition is fired. The charging handle 40 allows an operator to manually slide the bolt 36 relative to the upper receiver 24 to manually chamber a round of ammunition in the firearm 22 and/or manually eject a spent shell. The bolt hold open mechanism 44 allows the operator to manually hold the bolt 36 of the firearm 22 open by pushing up on an actuation button 56 of the bolt hold open mechanism 44. The actuation button 56 moves a lever arm 58 that engages the bolt 36 of the firearm 22 and prevents the bolt 36 from closing (i.e. sliding forward in the upper receiver 24 towards the barrel 30). The hand grip 46 is positioned adjacent to the removable trigger 34 and is configured to be gripped by the operator when the firearm 22 is being fired. The hand grip 46 shown in the illustrated example is a pistol grip; however, it should be appreciated that this grip could be replaced by grips of different configurations and designs. The magazine 48 of the firearm 22 holds multiple rounds of ammunition and feeds the rounds into the upper receiver 24.

The bullpup conversion kit 20 includes a lower receiver 60, a buttplate 62, and a trigger bar assembly 64. The lower receiver 60 extends longitudinally between a front end 66 and a rear end 68. The lower receiver 60 of the bullpup conversion kit 20 mounts below the upper receiver 24 of the firearm 22 such that the front end 66 of the lower receiver 60 is below the fore end 26 of the upper receiver 24 and the rear end 68 of the lower receiver 60 is below the back end 28 of the upper receiver 24. The lower receiver 60 has a topside 70 that abuts the upper receiver 24, a bottom wall 72 opposite the topside 70, an ejection side wall 74, and a non-ejection side wall 76 opposite the ejection side wall 74. The ejection side wall 74 is disposed on the same side of the firearm 22 as the ejection port 54. In the illustrated example, both the ejection port 54 and the ejection side wall 74 of the lower receiver 60 are on the right-side of the firearm 22; however, it should be appreciated that the ejection port 54 and the ejection side wall 74 of the lower receiver 60 could alternatively be on the left-side of the firearm 22.

The bullpup conversion kit 20 also includes a cheek rest 78, a picatinny riser 80, and a deflector 82. The cheek rest 78 is mounted over a picatinny rail 84 of the upper receiver 24. The picatinny rail 84 of the upper receiver 24 has a T-shaped cross-section and is adapted to receive a variety of different firearm accessories such as one or more sights and/or scopes. The cheek rest 78 extends longitudinally between a first end 86 and a second end 88. The second end 88 of the cheek rest 78 abuts the buttplate 62. The cheek rest 78 is configured to provide a smooth surface for an operator to rest their cheek against during firing. The picatinny riser 80 is also mounted over the picatinny rail 84 of the upper receiver 24. Although other mounting arrangements are possible, both the cheek rest 78 and the picatinny riser 80 may be mounted to the picatinny rail 84 of the upper receiver 24 using one or more fasteners. The picatinny riser 80 extends longitudinally between a proximal end 90 and a distal end 92. The proximal end 90 of the picatinny riser 80 abuts the first end 86 of the cheek rest 78. The picatinny riser 80 has an upper rail 94 with a T-shaped cross-section that is higher than the picatinny rail 84 of the upper receiver 24. Accordingly, the picatinny riser 80 allows different firearm accessories such as sights and/or scopes to be mounted higher relative to the barrel 30 of the firearm 22, which insures better positioning and ergonomics when the firearm 22 is converted to the bullpup configuration. The deflector 82 at least partially circumscribes the ejection port 54 on the upper receiver 24. The deflector 82 is mounted to the cheek rest 78 and is configured to direct spent shells out away from the cheek rest 78. Although other mounting arrangements are possible, the deflector 82 may be mounted to the cheek rest 78 using one or more fasteners.

Figure 4:
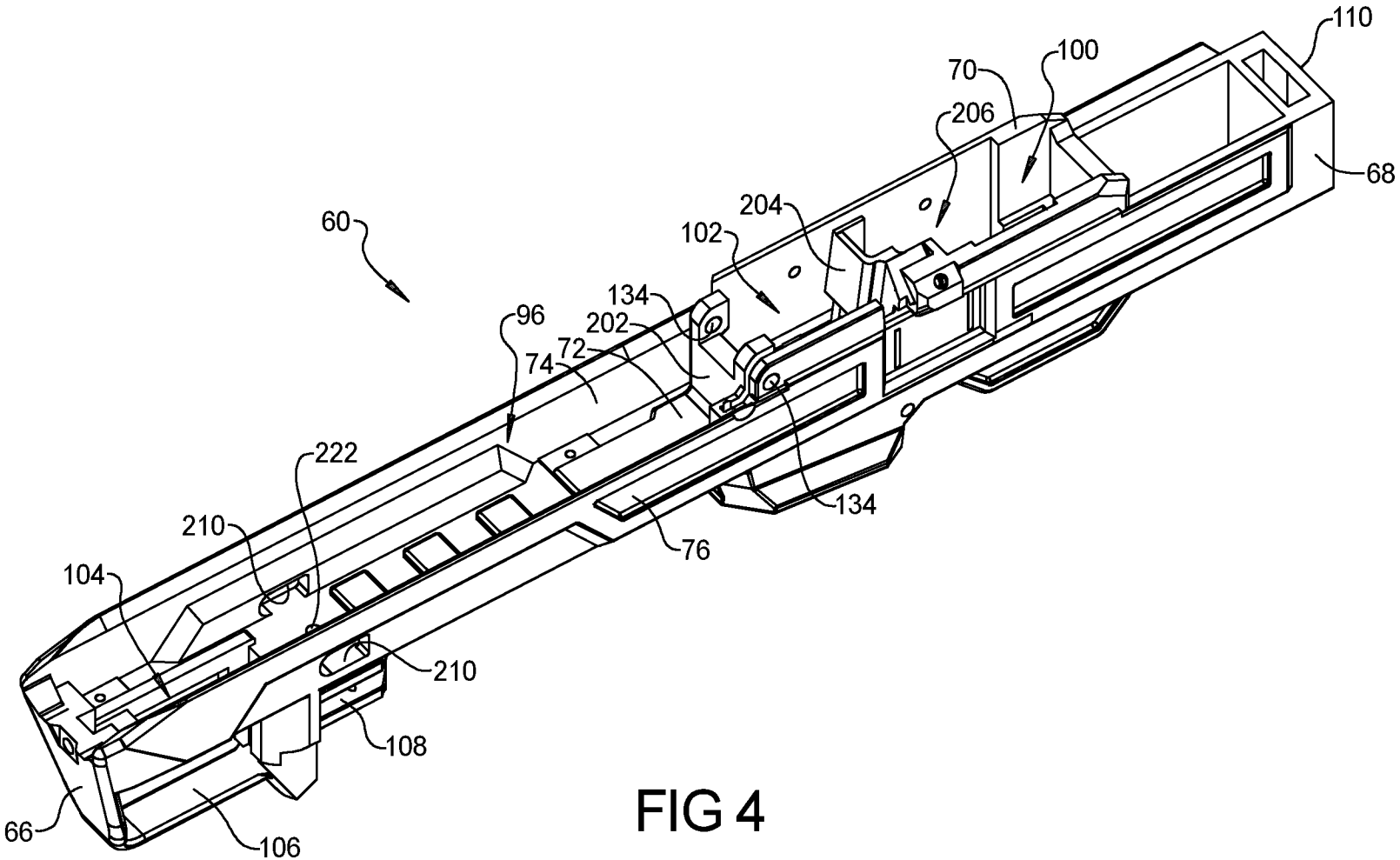
FIG. 4 is a side perspective view of an exemplary lower receiver of the exemplary bullpup conversion kit illustrated in FIG. 1.

As best seen in FIGS. 3 and 4, the topside 70 of the lower receiver 60 has a topside channel 96 that is configured to receive at least part of the upper receiver 24 of the firearm 22. In addition, the entire trigger bar assembly 64 is received within the topside channel 96 of the lower receiver 60. Because the trigger bar assembly 64 is entirely received in the topside channel 96 of the lower receiver 60, the trigger bar assembly 64 is protected and the bullpup conversion kit 20 has a finished appearance with improved aesthetics.

A portion of the top side channel includes a trigger pack pocket 100 that is configured to receive the trigger pack 32 of the firearm 22. The lower receiver 60 also includes a magazine well 102 that is open to the topside channel 96 and extends through the bottom wall 72 of the lower receiver 60 for releasably receiving the magazine 48 of the firearm 22. The magazine well 102 is longitudinally positioned adjacent to the trigger pack pocket 100. The magazine release lever 50 of the firearm 22 is pivotally connected to the bottom wall 72 of the lower receiver 60 adjacent to the magazine well 102. The actuation button 56 of the bolt hold open mechanism 44 extends through the non-ejection side wall 76 of the lower receiver 60 and the lever arm 58 of the bolt hold open mechanism 44 in positioned in the topside channel 96 adjacent to the trigger pack pocket 100 and the magazine well 102.

The front end 66 of the lower receiver 60 includes a trigger slot 104 and a trigger guard 106. The trigger slot 104 is open to the topside channel 96 and extends through the bottom wall 72 of the lower receiver 60. The removable trigger 34 is disposed in and extends through the trigger slot 104 in the front end 66 of the lower receiver 60. The lower receiver 60 also includes a hand grip attachment surface 108 disposed along the bottom wall 72 of the lower receiver 60. The hand grip attachment surface 108 is positioned longitudinally between the front end 66 of the lower receiver 60 and the magazine well 102. The hand grip 46 mounts to the hand grip attachment surface 108. In the illustrated example, the hand grip attachment surface 108 is provided in the form of a lug; however, other configurations of the hand grip attachment surface 108 are possible. The trigger guard 106 extends from the front end 66 of the lower receiver 60, around the removable trigger 34, and to the hand grip attachment surface 108. Accordingly, the trigger guard 106 helps prevent unwanted actuation of the removable trigger 34.

With reference to FIGS. 1-4, the rear end 68 of the lower receiver 60 includes a buttplate abutment surface 110. The buttplate abutment surface 110 on the rear end 68 of the lower receiver 60 abuts the buttplate 62, which mounts to the upper receiver 24. A buttpad 112 is mounted to the buttplate 62 such that the buttplate 62 is positioned longitudinally between the upper receiver 24 and the buttpad 112. The buttplate 62 includes a cantilevered shelf 114 that extends longitudinally away from the buttpad 112. When the buttplate 62 is installed on the upper receiver 24, the cantilevered shelf 114 of the buttplate 62 abuts the bottom wall 72 of the lower receiver 60 at a position adjacent to the rear end 68 of the lower receiver 60.

Although other mounting arrangements are possible, in the illustrated example, the buttplate 62 includes a pair of notched side plates 116 that engage a pair of grooves 118 on the upper receiver 24 adjacent to the back end 28 of the upper receiver 24. As such, the buttplate 62 is free to slide upwardly relative to the upper receiver 24 in a direction that is transverse to the barrel 30 of the firearm 22 until the cantilevered shelf 114 abuts the bottom wall 72 of the lower receiver 60. It should be appreciated that in a longarm configuration, a stock (not shown) would extend from and/or be mounted to the back end 28 of the upper receiver 24. The upper receiver 24 includes a locking button 120 that protrudes longitudinally outward from the back end 28 of the upper receiver 24. The locking button 120 is biased toward an extended position by a biasing spring 122 disposed in the upper receiver 24. The buttplate 62 includes a longitudinal bore 124 that receives the locking button 120. During assembly of the firearm 22, the locking button 120 is depressed and the buttplate 62 is slid upward relative to the upper receiver 24 until the cantilevered shelf 114 abuts the bottom wall 72 of the lower receiver 60, at which point, the locking button 120 becomes aligned with the longitudinal bore 124 in the buttplate 62. The biasing spring 122 forces the locking button 120 to the extended position and into the longitudinal bore 124 in the buttplate 62, locking the buttplate 62 in place. To disassemble the firearm 22, a tool or a finger is inserted into the longitudinal bore 124 from a buttpad side of the buttplate 62 to depress the locking button 120 and slide the locking button 120 out of the longitudinal bore 124 in the buttplate 62 and into the back end 28 of the upper receiver 24.

Optionally, the buttplate 62 may include a quick detach pocket 126. The quick detach pocket 126 extends through the buttplate 62 and is configured to receive a quick detach stud (not shown) for mounting a sling (not shown) to the firearm 22. The buttplate 62 may be constructed in numerous ways. In the illustrated embodiment, the buttplate 62 is formed by two buttplate halves 128*a*, 128*b* that abut one another and are held together by fasteners. However, the buttplate halves 128*a*, 128*b* may be welded or bonded together by an adhesive. Alternatively, the buttplate 62 could be constructed as a single piece.

The front end 66 of the lower receiver 60 includes a front hook 130 that is configured to engage an opening 132 in the fore end 26 of the upper receiver 24. The lower receiver 60 also includes a cross-pin bore 134 that is open to the topside channel 96 and extends through the ejection side wall 74 and the non-ejection side wall 76 of the lower receiver 60 at a location adjacent to the magazine well 102. The cross-pin 52 of the firearm 22 is slidably received in the cross-pin bore 134 such that the cross-pin 52 extends transversely across the topside channel 96 and through a pin bore 136 in the upper receiver 24. Together, the front hook 130, the cross-pin 52, and the buttplate 62 cooperate to provide three points of attachment between the lower receiver 60 and the upper receiver 24. In accordance with this arrangement, the lower receiver 60 is free to pivot towards and away from the upper receiver 24 about the front hook 130 when the cross-pin 52 and the buttplate 62 are removed from the upper receiver 24 during assembly or disassembly of the firearm 22. Even with the bullpup conversion kit 20 fitted, the firearm 22 is fast and easy to assemble and disassemble due to the three attachment points between the upper and lower receivers 24, 60. In addition, the pivoting motion of the lower receiver 60 relative to the upper receiver 24 of the firearm 22 facilitates proper alignment of the upper and lower receivers 24, 60 for easier assembly and disassembly.

Figure 5:
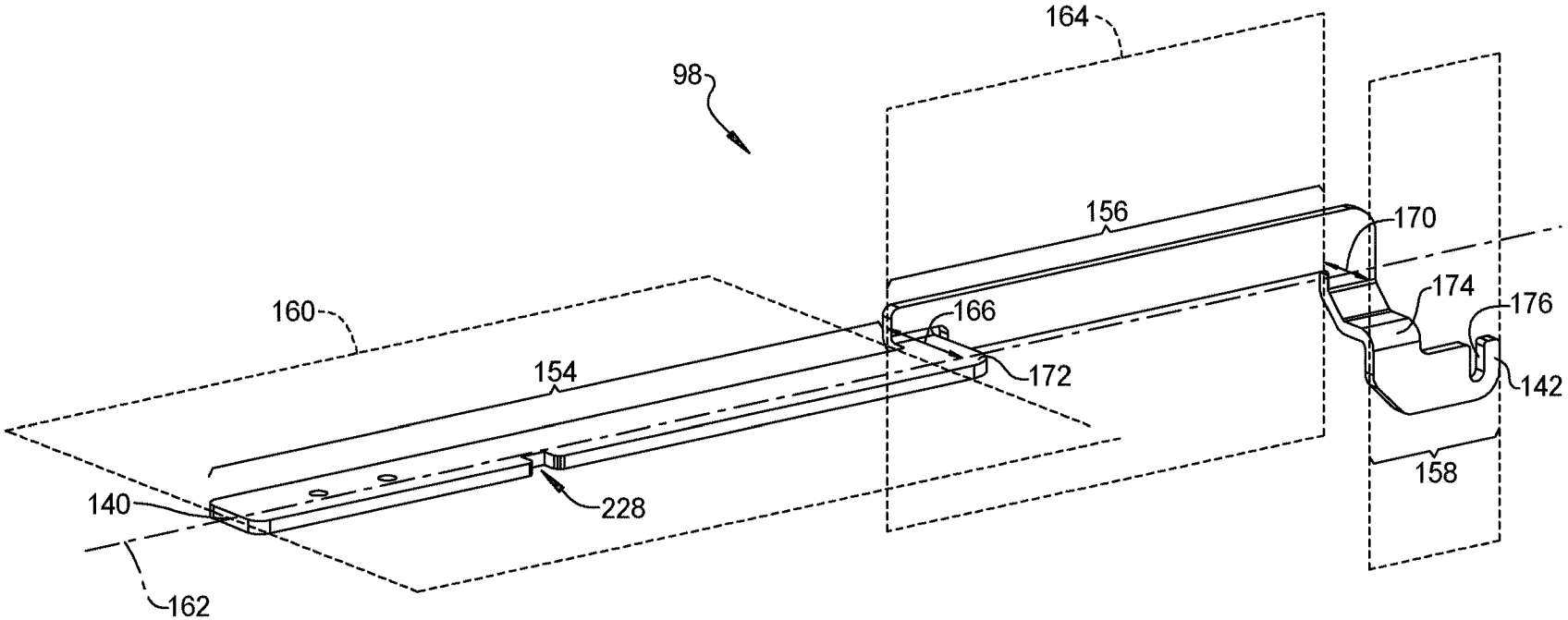
FIG. 5 is a side perspective view of an exemplary trigger bar of the exemplary bullpup conversion kit illustrated in FIG. 1.

With reference to FIGS. 3 and 5, the trigger bar assembly 64 includes a trigger bar 98 and a trigger shoe 138. The trigger bar 98 extends longitudinally between a forward end 140 and a rearward end 142. A front trigger mount 144 is attached to the forward end 140 of the trigger bar 98. The removable trigger 34 of the firearm 22 is coupled to the front trigger mount 144 by a trigger pin 146. It should be appreciated that the removable trigger 34 is configured to be detached from the trigger pack 32 of the firearm 22. For example, the removable trigger 34 may be attached to the trigger pack 32 by the trigger pin 146, which can be reused to couple the removable trigger 34 to the front trigger mount 144.

The trigger shoe 138 extends between an upper end 148 and a lower end 150. The upper end 148 of the trigger shoe 138 is pivotally coupled to the trigger pack 32 in place of the removable trigger 34. Meanwhile, the lower end 150 of the trigger shoe 138 is connected to the rearward end 142 of the trigger bar 98. A pair of trigger bar retainers 152, attached to the lower receiver 60, extend around the trigger bar 98 and hold the trigger bar 98 in contact with the bottom wall 72 of the lower receiver 60. Although other mounting arrangements are possible, each of the trigger bar retainers 152 may be mounted to the bottom wall 72 of the lower receiver 60 using one or more fasteners. Although two trigger bar retainers 152 are shown in the illustrated embodiment, it should be appreciated that any number of trigger bar retainers may be used including a single trigger bar retainer.

The trigger bar 98 includes a first segment 154 adjacent to the forward end 140 of the trigger bar 98, a second segment 156, and a third segment 158 adjacent to the rearward end 142 of the trigger bar 98. Accordingly, the second segment 156 of the trigger bar 98 extends between the first and third segments 154, 158 of the trigger bar 98. In the illustrated example, the first segment 154 of the trigger bar 98 extends longitudinally in a horizontal plane 160 along a first longitudinal axis 162. The second segment 156 of the trigger bar 98 extends longitudinally in a first vertical plane 164 that is parallel to and offset from the first longitudinal axis 162 by a first off-set distance 166. The third segment 158 of the trigger bar 98 extends longitudinally in a second vertical plane 168 that is parallel to and offset from the first vertical plane 164 by a second off-set distance 170. Optionally, the first off-set distance 166 and the second off-set distance 170 may equal one another such that the first longitudinal axis 162 extends along the second vertical plane 168. Alternatively, the first and second off-set distances 166, 170 may be different.

The trigger bar 98 includes a horizontal bend 172 that extends between the first and second segments 154, 156 of the trigger bar 98 and a stepped bend 174 that extends between the second and third segments 156, 158 of the trigger bar 98. The third segment 158 of the trigger bar 98 includes a trigger bar slot 176 adjacent the rearward end 142 of the trigger bar 98. The trigger bar slot 176 is open and forms a hook-like shape in the illustrated embodiment; however, the trigger bar slot 176 could alternatively be closed and/or have a shape that is different from the rectangular shape shown in FIG. 5.

Figure 6:
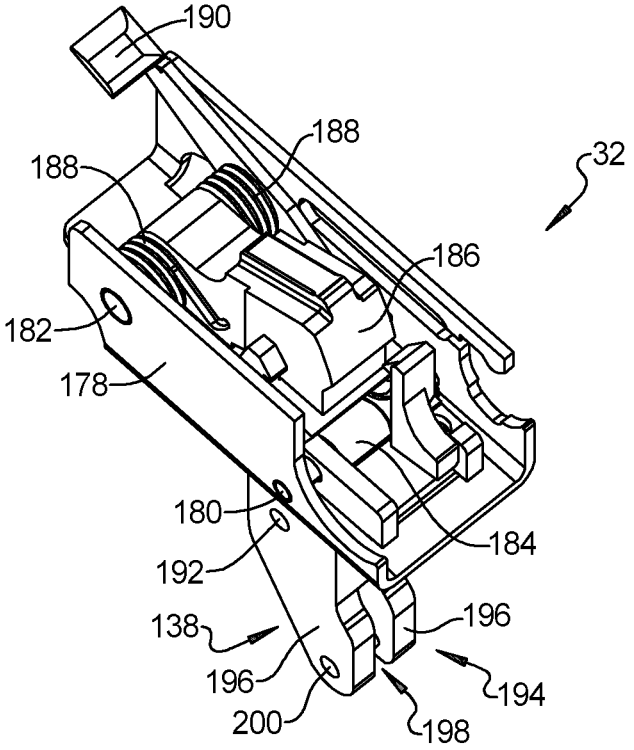
FIG. 6 is a side perspective view of an exemplary trigger pack and trigger shoe of the exemplary firearm and bullpup conversion kit illustrated in FIG. 1.
Figure 7:
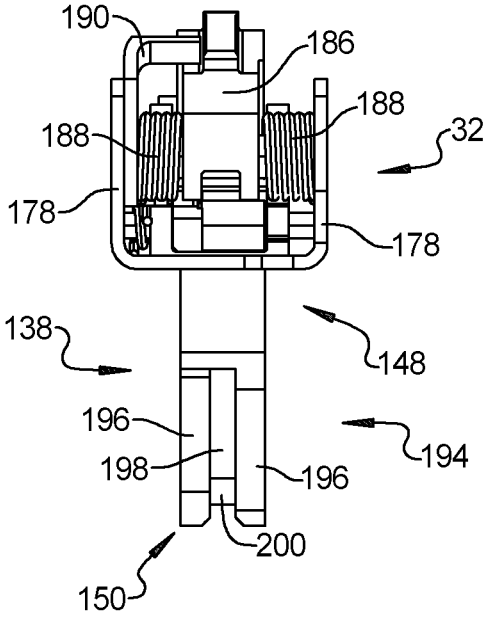
FIG. 7 is a front elevation view of the exemplary trigger pack and trigger shoe illustrated in FIG. 6.

With additional reference to FIGS. 6 and 7, the trigger pack 32 includes a housing 178, a sear axle 180 that extends through (i.e., across) the housing 178, and a hammer axle 182 that extends through (i.e., across) the housing 178. A sear 184 is rotatably supported on the sear axle 180. The sear 184 releasably engages a hammer 186 that is rotatably supported on the hammer axle 182. At least one torsion spring 188 is wound about the hammer axle 182 to bias the hammer 186 to a forward position when the sear 184 disengages the hammer 186. The trigger pack 32 also includes a block lever 190 that prevents the hammer 186 from contacting the firing pin when the bolt 36 of the firearm 22 is not fully closed (i.e., not fully forward). A sear pin 192 couples the upper end 148 of the trigger shoe 138 to the sear 184 such that the trigger shoe 138 pivots with the sear 184 about the sear axle 180.

The lower end 150 of the trigger shoe 138 includes a yoke 194 formed by a pair of plates 196 that are spaced apart by a gap 198. A trigger bar pin 200 extends across the gap 198 and between the pair of plates 196 of the trigger shoe 138. The third segment 158 of the trigger bar 98 is received in the gap 198 of the yoke 194 and is therefore supported between the pair of plates 196. The trigger bar pin 200 is received in the trigger bar slot 176 in the third segment 158 of the trigger bar 98 to couple the trigger shoe 138 to the rearward end 142 of the trigger bar 98. When the removable trigger 34 is pulled back towards the hand grip 46, the trigger bar 98 slides longitudinally in the topside channel 96 towards the rear end 68 of the lower receiver 60, which causes the trigger shoe 138 and the sear 184 to rotate about the sear axle 180. Rotation of the sear 184 releases the hammer 186, which is driven to the forward position by the torsion spring(s) 188. In the forward position, the hammer 186 falls on the firing pin of the firearm 22, which fires a round of ammunition. Advantageously, the length of pull and the pull weight for the removable trigger 34 can be set to the firearm manufacture's specifications or adjusted as desired because the trigger shoe 138 replaces the removable trigger 34 of the firearm 22 and the trigger bar 98 is securely coupled to the trigger shoe 138 by the trigger bar pin 200.

Figure 8:
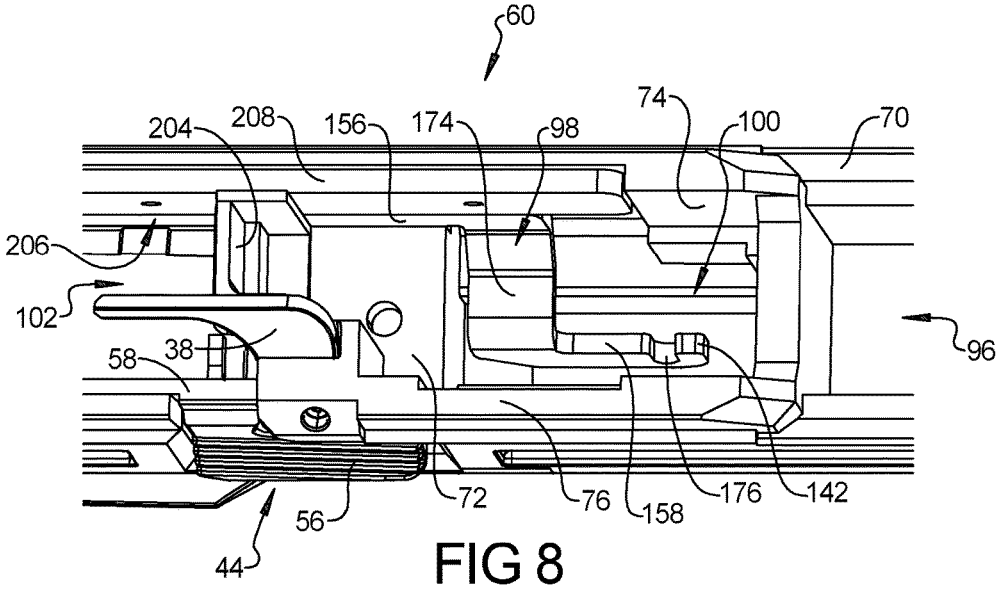
FIG. 8 is an enlarged top perspective view of a portion of the exemplary lower receiver and trigger bar illustrated in FIGS. 4 and 5.
Figure 9:
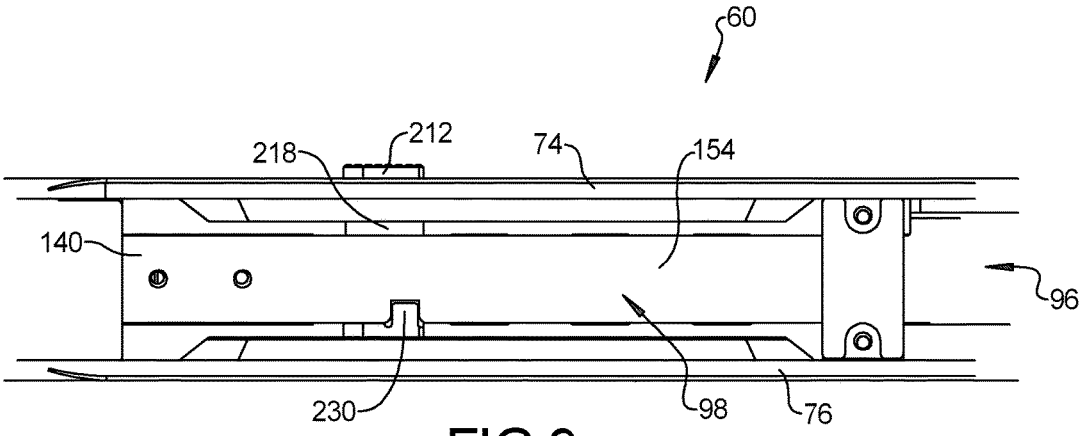
FIG. 9 is another enlarged top perspective view of a different portion of the exemplary lower receiver and trigger bar illustrated in FIGS. 4 and 5.

With additional reference to FIGS. 8 and 9, the lower receiver 60 includes a front magazine well wall 202 and a rear magazine well wall 204. The magazine well 102 is bounded by the front magazine well wall 202, the rear magazine well wall 204, and portions of the ejection side wall 74 and the non-ejection side wall 76 of the lower receiver 60. The rear magazine well wall 204 separates the magazine well 102 from the trigger pack pocket 100. The ejection side wall 74 of the lower receiver 60 has a trigger bar channel 206 that extends to one side of the magazine well 102 and the trigger pack pocket 100. The trigger bar channel 206 is also open to the magazine well 102 and the trigger pack pocket 100. The first segment 154 of the trigger bar 98 is substantially flat and is held against the bottom wall 72 of the lower receiver 60 by the trigger bar retainers 152 in a sliding fit. Meanwhile, the second segment 156 of the trigger bar 98 is slidingly received in and extends through the trigger bar channel 206 in the ejection side wall 74 of the lower receiver 60. Accordingly, the trigger bar 98 extends to only one side of the magazine well 102. Finally, the stepped bend 174 and the third segment 158 of the trigger bar 98 are slidingly disposed in the trigger pack pocket 100. Advantageously, this arrangement makes the bullpup conversion kit 20 compatible with firearms 22 that have an ejector 38 and/or a bolt hold open mechanism 44 located adjacent to the magazine well 102 because the trigger bar 98 runs along only one side of the magazine well 102 and therefore does not interfere with the ejector 38 or the bolt hold open mechanism 44.

As shown in FIG. 8, the rear magazine well wall 204 is spaced from the ejection side wall 74 of the lower receiver 60. The trigger bar channel 206 extends through this space between the rear magazine well wall 204 and the ejection side wall 74 of the lower receiver 60. A retainer plate 208 is also disposed in the space between the rear magazine well wall 204 and the ejection side wall 74 of the lower receiver 60 at a position above the second segment 156 of the trigger bar 98. As a result, the retainer plate 208 and the ejection side wall 74 cooperate to define the trigger bar channel 206. The retainer plate 208 abuts one side of the housing 178 of the trigger pack 32. Accordingly, the retainer plate 208 prevents the sear axle 180 and the hammer axle 182 from moving axially relative to the housing 178 of the trigger pack 32. Although the trigger bar channel 206 extends along the ejection side wall 74 in the illustrated embodiment, it should be appreciated that the trigger bar channel 206 could extend along the non-ejection side wall 76 in an alternative embodiment depending on the location of the ejector 38 and/or bolt hold open mechanism 44. Similarly, although the trigger pack 32 may be mounted to the lower receiver 60 in other ways, in the illustrated embodiment, the trigger pack 32 is mounted to the lower receiver 60 by a fastener that extends through a hole in the bottom wall 72 of the lower receiver 60.

As shown in FIGS. 3 and 9, the lower receiver 60 includes a safety cross-bore 210 that is open to the topside channel 96 and extends through the ejection side wall 74 and the non-ejection side wall 76 of the lower receiver 60 at a location above the hand grip attachment surface 108. A safety 212 is slidably received in the safety cross-bore 210 such that the safety 212 extends transversely across the topside channel 96 in the lower receiver 60. The safety 212 includes a bottom surface 214 that faces the bottom wall 72 of the lower receiver 60 and a top surface 216 opposite the bottom surface 214. The top surface 216 of the safety 212 has a trigger bar groove 218 and the bottom surface 214 of the safety 212 includes at least two detents 220.

The detents 220 in the bottom surface 214 of the safety 212 define a safety position and a firing position of the safety 212. Although other configurations are possible, in the illustrated embodiment, the safety 212 is flush with the non-ejection side wall 76 of the lower receiver 60 and protrudes outwardly from the ejection side wall 74 of the lower receiver 60 when the safety 212 is in the safety position. By contrast, the safety 212 is flush with the ejection side wall 74 of the lower receiver 60 and protrudes outwardly from the non-ejection side wall 76 of the lower receiver 60 when the safety 212 is in the firing position. The bottom wall 72 of the lower receiver 60 includes a spring bore 222 that is open to the topside channel 96. A detent spring 224 and a detent cylinder 226 are disposed in the spring bore 222. The detent spring 224 biases the detent cylinder 226 upwardly to an extended position. The detent cylinder 226 includes a domed end that engages the detents 220 in the bottom surface 214 of the safety 212 to hold the safety 212 in the safety position and the firing position.

The first segment 154 of the trigger bar 98 extends through the trigger bar groove 218 in the safety 212. The first segment 154 of the trigger bar 98 includes a safety notch 228 and the safety 212 includes a lug 230 disposed in the trigger bar groove 218. When the safety 212 is slid into the safety position, the lug 230 of the safety 212 engages the safety notch 228, preventing the trigger bar 98 from sliding longitudinally in the topside channel 96 towards the rear end 68 of the lower receiver 60. This prevents firing. When the safety 212 is slid into the firing position, the lug 230 disengages the safety notch 228 in the first segment 154 of the trigger bar 98 and the trigger bar 98 is thus free to slide longitudinally in the topside channel 96 in response to the operator pulling the removable trigger 34 back towards the hand grip 46 to fire the firearm 22.

In operation, the safety 212 is slid to the firing position to disengage the lug 230 of the safety 212 from the safety notch 228 in the trigger bar 98, allowing the firearm 22 to fire. Pressure on the removable trigger 34 is translated through the trigger bar 98 to the trigger shoe 138, which in turn activates the trigger pack 32 and causes the firearm 22 to fire. The firearm 22 will continue to fire as the removable trigger 34 is pulled until the safety 212 is placed in a position that will prevent pressure on the removable trigger 34 from operating the trigger pack 32 or until ammunition from the magazine 48 is fully expended. Upon full expenditure of ammunition from the magazine 48, the bolt hold open mechanism 44 is forced upward by internal action of the magazine 48 and locks the bolt 36 of the firearm 22 open. The magazine release lever 50 can then be pressed to release the magazine 48 from the magazine well 102 for reloading.

Many modifications and variations of the present invention are possible in light of the above teachings and may be practiced otherwise than as specifically described while within the scope of the appended claims. These antecedent recitations should be interpreted to cover any combination in which the inventive novelty exercises its utility.

What is claimed is:

1. A bullpup conversion kit for a firearm including an upper receiver, a barrel extending from the upper receiver, and a trigger pack with a removable trigger, said bullpup conversion kit comprising:

a lower receiver extending longitudinally between a front end and a rear end;

said front end of said lower receiver including a trigger slot;

said lower receiver including a topside channel that is configured to receive at least part of the upper receiver of the firearm;

said top side channel of said lower receiver including a trigger pack pocket positioned longitudinally between said trigger slot and said rear end of said lower receiver that is configured to receive the trigger pack of the firearm;

a trigger bar assembly entirely received within said topside channel of said lower receiver, said trigger bar assembly including a trigger bar, a front trigger mount, and a trigger shoe;

said trigger bar extending between a forward end and a rearward end;

said front trigger mount disposed on said forward end of said trigger bar and configured to receive the removable trigger of the firearm;

said trigger shoe including an upper end that is configured to be pivotally coupled to the trigger pack in place of the removable trigger for movement between a forward position and a firing position; and a lower end that is coupled to said rearward end of said trigger bar said trigger shoe including a trigger bar pin that is fixedly coupled to a lower end of said trigger shoe and said rearward end of said trigger bar including a trigger bar slot, wherein said trigger bar pin is received in said trigger bar slot when said trigger shoe is in said forward position and said firing position.

2. The bullpup conversion kit set forth in claim 1, wherein said lower end of said trigger shoe includes a yoke presenting a gap that receives said rearward end of said trigger bar.

3. The bullpup conversion kit set forth in claim 2, wherein said trigger bar pin extends across said gap in said yoke of said trigger shoe and wherein said rearward end of said trigger bar includes a trigger bar slot that receives said trigger bar pin to couple said rearward end of said trigger bar to said lower end of said trigger shoe.

4. The bullpup conversion kit set forth in claim 3, wherein said yoke of said trigger shoe includes a pair of plates that are spaced apart by said gap, said pair of plates supporting said rearward end of said trigger bar.

5. The bullpup conversion kit set forth in claim 1, wherein said trigger bar includes a first segment adjacent said forward end of said trigger bar, a second segment, and a third segment adjacent said rearward end of said trigger bar, said second segment of said trigger bar extending between said first and third segments of said trigger bar.

6. The bullpup conversion kit set forth in claim 5, wherein said first segment of said trigger bar extends longitudinally in a horizontal plane along a first longitudinal axis, said second segment of said trigger bar extends longitudinally in a first vertical plane that is parallel to and offset from said first longitudinal axis by a first off-set distance, and said third segment of said trigger bar extends longitudinally in a second vertical plane that is parallel to and offset from said first vertical plane by a second off-set distance.

7. The bullpup conversion kit set forth in claim 6, wherein said first off-set distance equals said second off-set distance such that said first longitudinal axis extends along said second vertical plane.

8. The bullpup conversion kit set forth in claim 6, wherein said trigger bar includes a horizontal bend that extends between said first and second segments of said trigger bar and a stepped bend that extends between said second and third segments of said trigger bar.

9. The bullpup conversion kit set forth in claim 5, wherein said lower receiver includes a bottom wall, an ejection side wall, and a non-ejection side wall.

10. The bullpup conversion kit set forth in claim 9, wherein said trigger bar assembly includes at least one trigger bar retainer attached to said lower receiver that extends around said first segment of said trigger bar to hold said first segment of said trigger bar against said bottom wall of said lower receiver in a sliding fit.

11. The bullpup conversion kit set forth in claim 9, wherein said lower receiver includes a safety cross-bore that extends through said ejection side wall and said non-ejection side wall of said lower receiver and wherein a safety extends transversely across said topside channel and is slidably received in said safety cross-bore for movement between a safety position and a firing position, said safety including a trigger bar groove that slidably receives said first segment of said trigger bar, said first segment of said trigger bar including a safety notch, and said safety including a lug disposed in said trigger bar groove that engages said safety notch in said first segment of said trigger bar when said safety is slid into said safety position and disengages said safety notch in said first segment of said trigger bar when said safety is slid into said firing position.

12. The bullpup conversion kit set forth in claim 9, wherein said lower receiver includes a front magazine well wall and a rear magazine well wall that cooperate with portions of said ejection side wall and said non-ejection side wall to define a magazine well that extends through said bottom wall of said lower receiver, wherein one of said side walls includes a trigger bar channel passing to one side of said magazine well that opens into said trigger pack pocket, and wherein said second segment of said trigger bar is slidingly disposed in and extends through said trigger bar channel and said third segment of said trigger bar is slidingly disposed in said trigger pack pocket.

13. The bullpup conversion kit set forth in claim 12, wherein said rear magazine well wall is spaced from said ejection side wall of said lower receiver such that said trigger bar channel extends between said rear magazine well wall and said ejection side wall of said lower receiver and wherein a retainer plate is disposed between said rear magazine well wall and said ejection side wall of said lower receiver such that said retainer plate and said ejection side wall cooperate to define said trigger bar channel, said retainer plate abutting one side of the trigger pack to support the trigger pack in said trigger pack pocket.

14. A bullpup conversion kit for a firearm including an upper receiver, a barrel extending from the upper receiver, and a trigger pack, said bullpup conversion kit comprising:

a lower receiver extending longitudinally between a front end and a rear end;

said lower receiver including a topside channel that is configured to receive at least part of the upper receiver of the firearm, a bottom wall opposite said topside channel, an ejection side wall, and a non-ejection side wall;

said top side channel of said lower receiver including a trigger pack pocket that is configured to receive the trigger pack;

said lower receiver including a magazine well that is open to said topside channel and extends through said bottom wall of said lower receiver for releasably receiving a magazine;

said front end of said lower receiver including a trigger slot that extends through said bottom wall of said lower receiver;

a trigger bar assembly entirely received within said topside channel of said lower receiver, said trigger bar assembly including a trigger bar that extends between a forward end and a rearward end;

said forward end of said trigger bar including a trigger that extends through said trigger slot in said lower receiver and said rearward end of said trigger bar configured to couple to the trigger pack;

said lower receiver including a trigger bar channel that extends along one side of said magazine well and said trigger pack pocket;

said trigger bar slidingly disposed in and extending through said trigger bar channel in said lower receiver such that said trigger bar extends along only one side of said magazine well;

said lower receiver including a front magazine well wall and a rear magazine well wall that cooperate with portions of said ejection side wall and said non-ejection side wall to define said magazine well, said rear magazine well wall spaced from one of said side walls of said lower receiver to partially define said trigger bar channel; and a retainer plate is disposed between said rear magazine well wall and one of said side walls of said lower receiver to partially define said trigger bar channel, said retainer plate abutting one side of the trigger pack to support the trigger pack in said trigger pack pocket.

15. The bullpup conversion kit set forth in claim 14, wherein said rear magazine well wall separates said magazine well from said trigger pack pocket.

16. A bullpup conversion kit for a firearm including an upper receiver and a barrel extending from the upper receiver, said bullpup conversion kit comprising:

a lower receiver extending longitudinally between a front end and a rear end;

said lower receiver including a topside channel that is configured to receive at least part of the upper receiver of the firearm, a bottom wall having a bottom surface, an ejection side wall, and a non-ejection side wall;

said front end of said lower receiver including a trigger slot extending through said bottom wall of said lower receiver;

said lower receiver including a magazine well extending through said bottom wall of said lower receiver for releasably receiving a magazine, said magazine well positioned longitudinally between said trigger slot and said rear end of said lower receiver;

a buttplate abutting said rear end of said lower receiver;

said front end of said lower receiver including a front hook configured to engage an opening in the upper receiver;

said lower receiver including a cross-pin bore extending through said ejection side wall and said non-ejection side wall of said lower receiver adjacent said magazine well;

a cross-pin slidably received in said cross-pin bore that extends transversely across said topside channel and that is configured to engage a bore in the upper receiver;

said buttplate including a cantilevered shelf that abuts said bottom surface of said bottom wall of said lower receiver adjacent to said rear end of said lower receiver; and said front hook, said cross-pin, and said buttplate cooperating to provide three points of attachment between said lower receiver and the upper receiver where said lower receiver is free to pivot towards and away from the upper receiver about said front hook when said cross-pin and said buttplate are removed from the upper receiver during assembly or disassembly of the firearm.

17. The bullpup conversion kit set forth in claim 16, wherein said buttplate includes a pair of notched side plates that engage a pair of grooves on the upper receiver such that said buttplate is free to slide in a direction that is transverse to the barrel until said cantilevered shelf abuts said bottom wall of said lower receiver.

18. The bullpup conversion kit set forth in claim 16, wherein said lower receiver includes a hand grip attachment surface disposed along said bottom wall of said lower receiver, wherein said hand grip attachment surface is positioned longitudinally between said front end of said lower receiver and said magazine well, and wherein a hand grip is mounted to said hand grip attachment surface on said front end of said lower receiver.

* * * * *